United States Patent [19]

Dagenais

[11] Patent Number: 4,848,436

[45] Date of Patent: Jul. 18, 1989

[54] FOLDING ACCESS DOOR IN A FOLDABLE CLOSURE ASSEMBLY

[76] Inventor: Robert Dagenais, 86 Grandcote, St. Eustache, Quebec, Canada, J7P 1A6

[21] Appl. No.: 99,400

[22] Filed: Sep. 22, 1987

[51] Int. Cl.[4] ..... E05D 15/26

[52] U.S. Cl. ..... 160/199; 160/118

[58] Field of Search ..... 160/199, 206, 213, 229.1, 160/232, 234, 235, 117, 118

[56] References Cited

U.S. PATENT DOCUMENTS

| | | | |
|---|---|---|---|
| 1,426,969 | 8/1922 | Dunham . | |
| 1,463,346 | 7/1923 | Walker . | |
| 2,713,897 | 7/1955 | Teague et al. | 160/117 |
| 2,770,298 | 11/1956 | Hiatt | 160/199 |
| 2,954,081 | 9/1960 | Recchione | 160/219 |
| 3,359,594 | 12/1967 | Pastoor | 160/199 X |
| 3,494,408 | 2/1970 | D'Ercole | 160/118 X |
| 3,670,797 | 6/1972 | Sassano | 160/206 X |
| 3,799,237 | 3/1974 | Proserpi | 160/199 |
| 3,972,365 | 8/1976 | Dixon | 160/183 |
| 4,228,841 | 10/1980 | Dixon | 160/199 X |
| 4,315,648 | 2/1982 | Labelle | 292/150 |
| 4,380,260 | 4/1983 | Labelle | 160/183 X |
| 4,383,569 | 5/1983 | Labelle | 160/116 |
| 4,386,645 | 6/1983 | Dever et al. | 160/183 |
| 4,497,357 | 2/1985 | Labelle | 160/199 |
| 4,660,613 | 4/1987 | Dagenais | 160/199 |

FOREIGN PATENT DOCUMENTS 1162839 2/1984 Canada .

*Primary Examiner*—Ramon S. Britts
*Assistant Examiner*—David M. Purol

[57] ABSTRACT

A foldable closure assembly which includes a number of panels vertically hinged together supported from rollers in a top support track, is provided with a full height folding access door. Two vertical posts provide center posts for the access door, each post vertically hinged to an adjacent access door panel which has no top support roller; a guiding device retains the two posts in a closed adjacent position, allowing the two posts to separate when they are pushed from inside the assembly, and a latch joins the two posts together.

6 Claims, 4 Drawing Sheets

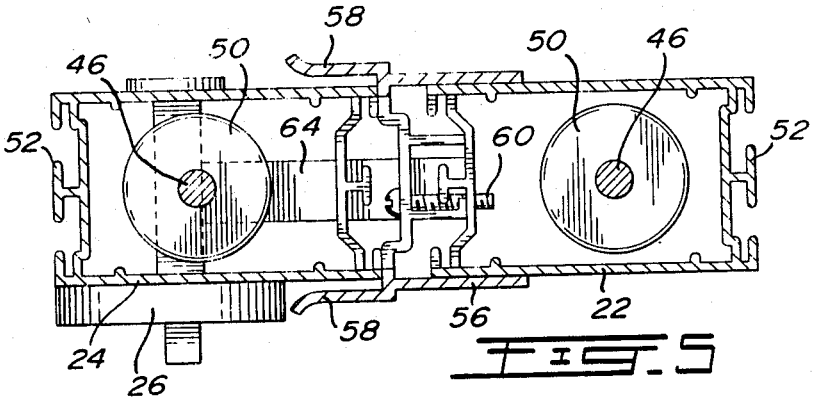
FIG. 5
FIG. 6
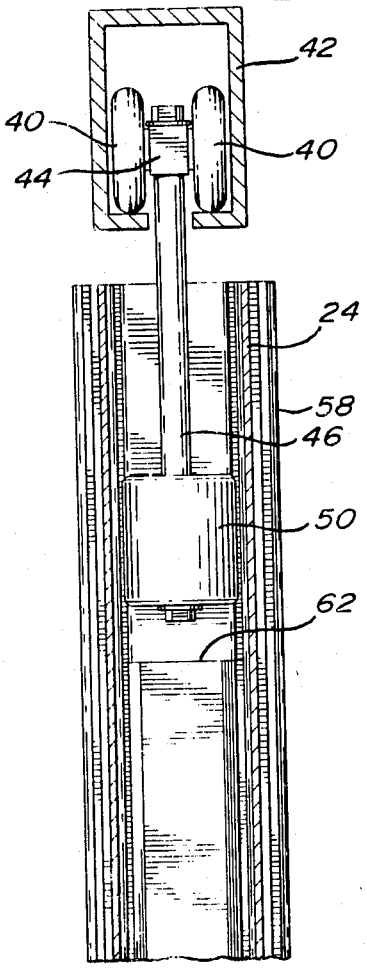

FOLDING ACCESS DOOR IN A FOLDABLE CLOSURE ASSEMBLY

FIELD AND BACKGROUND OF THE INVENTION

The present invention relates to a foldable closure assembly which includes a plurality of panels with adjacent panels vertically hinged together and top support rollers for supporting the foldable closure assembly in a top support track. More specifically, the present invention provides a full height folding access door for a foldable closure assembly.

Foldable closure assemblies are generally used across storefronts in shopping malls and the like. When the closure assemblies are closed, then panels in the assembly are in a substantial straight line supported beneath a top support track. If the support track is curved, then the foldable closure assemblies generally follow this curved configuration. When the assembly is open, the panels are accordioned together and in some cases may fit into a compartment at one side of the opening. When the foldable closure assemblies extend across a large opening, there is a need in some circumstances to have an access door just wide enough for an individual to pass through without having to open the complete assembly This is useful for store owners to enter and also may be used as an emergency door so that in an emergency, a person inside the area enclosed by the foldable closure assembly can easily and quickly leave the area without having to take the time to open the complete closure assembly. Fire regulations require an emergency door as a fire exit which opens when pushed, swinging outwards In a foldable closure assembly, however, a single panel is not generally wide enough for an access door, so the door has to extend across several panels. Thus the access door itself must be foldable so that when the foldable closure assembly is opened and the panels accordioned together, the panels of the access door fold with the panels of the closure assembly. Various types of access doors have been provided in the past. In one case an access door is provided which does not extend for the full height of the closure assembly Whereas this permits support rollers to support the portion of the panels above the access door, there is, however, no support for the door itself and it has to extend across the access door opening, support itself and have sufficient stiffness to maintain it's position in the closure assembly. In some cases such a door becomes too flexible and somewhat flimsy.

SUMMARY OF THE INVENTION

It is an aim of the present invention to provide a folding access door in a foldable closure assembly which extends to the full height of the closure assembly and has joining vertical posts dividing the door into two halves. The posts are latched together and when unlatched, swing open when pushed from the inside of the closure assembly.

The present invention provides in a foldable closure assembly, including a plurality of panels with adjacent panels vertically hinged together, and top support rollers supporting the foldable closure assembly in a top support track; the improvement of a full height folding access door in two halves hinged to adjacent panels, each supported by a support roller in the top support track comprising: two vertical posts, each post vertically hinged to an adjacent access door panel, which has no top support rollers; guide means for retaining the two posts in a closed adjacent position, allowing the two posts to separate when the two posts are pushed from inside the foldable closure assembly, and latching means for joining the two posts together.

In a further embodiment of the invention, there is provided in a foldable closure assembly, including a plurality of panels with adjacent panels vertically hinged together and top support rollers supporting the foldable closure assembly in a top support track; the improvement of a full height folding access door in two halves, hinged to adjacent panels, each supported by a support roller in the top support track comprising: two vertical posts, each post vertically hinged to an adjacent access door panel, each post having a top portion with an opening on a side facing towards each other; latching means for joining the two posts together, and guide means removably fitting in the top portions of the two posts, the guide means supported from the top support track such that when the two posts are latched together, the guide means is retained in the top portions, and when the two posts are unlatched, the posts can pivot and the two halves of the access door open leaving the guide means in place.

BRIEF DESCRIPTION OF THE DRAWINGS

FIG. 5 is a sectional view taken at line 5—5 of FIG. 4;

FIG. 6 is a sectional view taken at line 6—6 of FIG. 4.

DESCRIPTION OF THE EMBODIMENT

Figure 1:
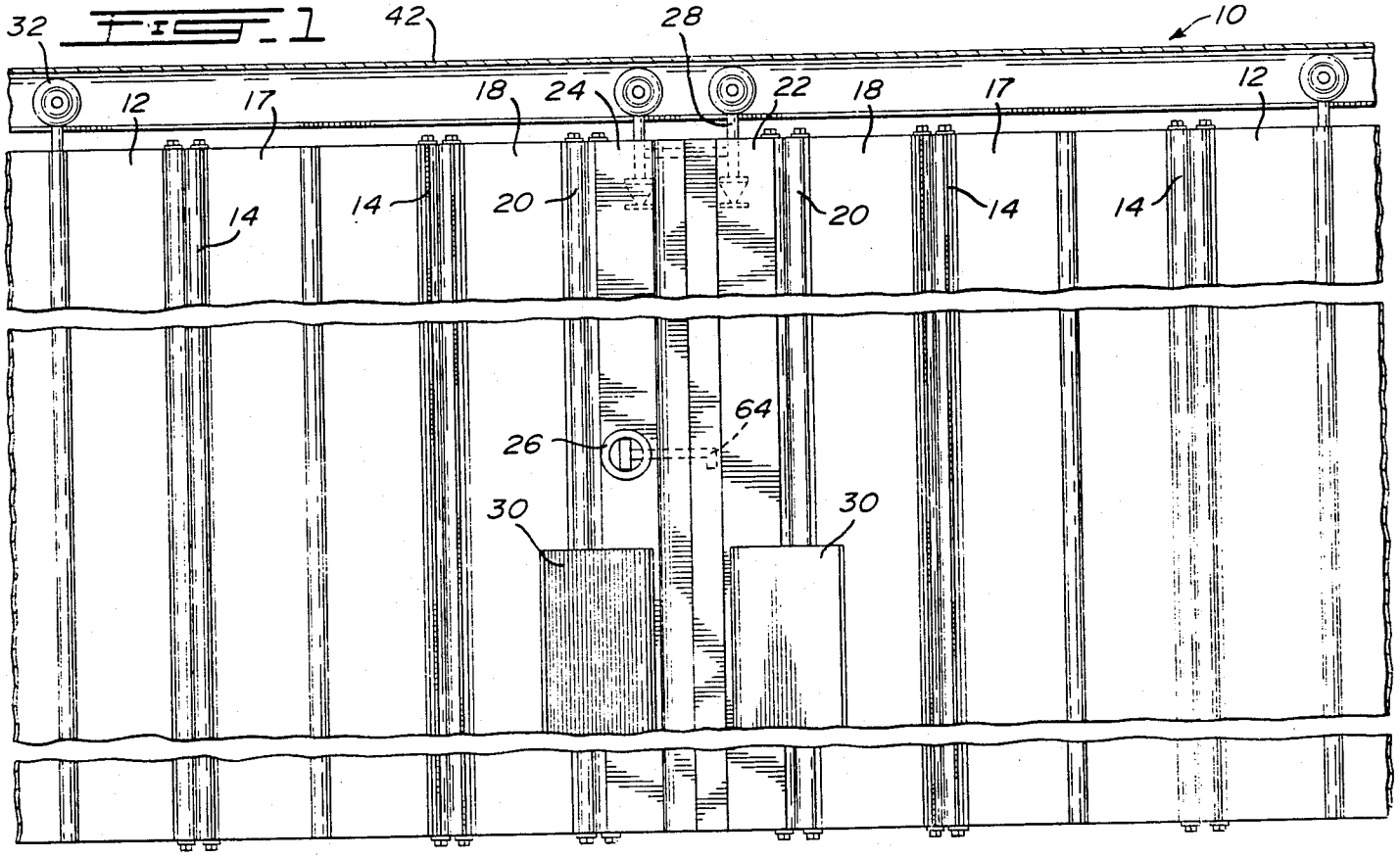
FIG. 1 is a partial front view from the inside of a foldable closure assembly showing one embodiment of a folding access door therein.
Figure 2:
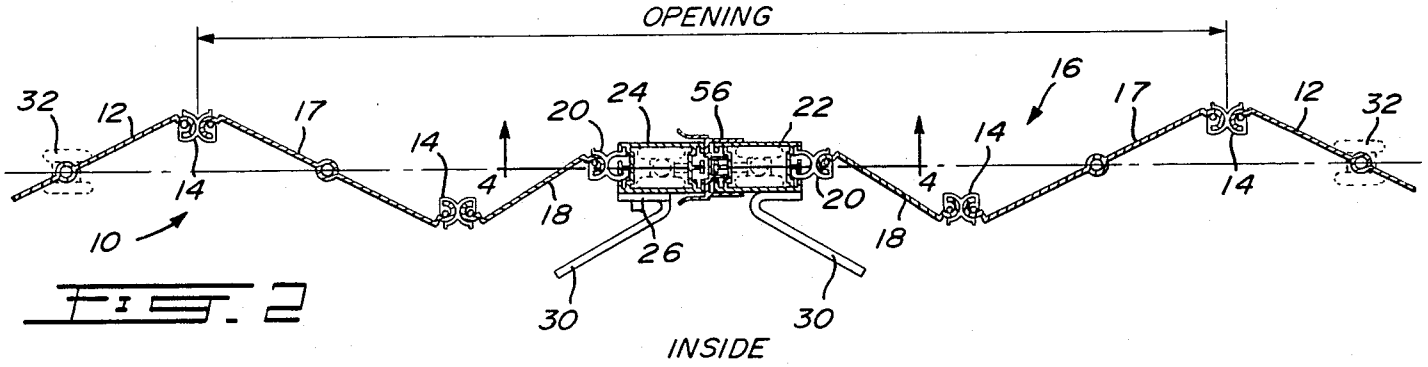
FIG. 2 is a top plan view of the foldable closure assembly shown in FIG. 1.

Referring now to FIGS. 1 and 2, a foldable closure assembly 10 is shown having panels 12 which join at vertical hinge members 14 allowing the panels 12 to be folded in an accordion like fashion. FIG. 2 shows the foldable closure assembly 10 in a partially open configuration, the panels 12 are not substantially in line, but are in a slight zig-zag configuration for purposes of illustration. When the assembly is completely closed, the panels 12 are substantially in line, when the assembly is in the open or folded configuration, the panels fold one upon the other. A folding access door 16 extends for the full height of the foldable closure assembly 10 and as shown in FIGS. 1 and 2, has an access door panel 17 which is substantially the same as the adjacent panel 12 to the access door 16, but does not have any top guide roller support and is free to swing open. The access door panel 17 joins to a hinge member 14 which in turn is connected to a half panel 18. The hinge members 14 all act as pivot points, so the access door panel 17 swivels about the hinge member 14 on the adjacent panel 12 which then becomes the access door hinge. The half panel 18 also swivels about the hinge member 14 joined to the access door panel 17. The two half panels 18 each connect to a modified hinge member 20 which are each rigidly attached to vertical posts 22 and 24. The half panels 18 can pivot or swivel in the modified hinge members 20. A rotating latch 26 which is provided at a suitable height on the vertical post 24 latches and holds the vertical posts 22 and 24 together. A guide roller assembly 28 at the top of the posts 22 and 24, positions the vertical posts 22 and 24 when they are latched and the folding access door 16 is closed. Curved handles 30 are located on each side of the posts 22 and 24 such that when the ends of the handles are pushed, the posts 22 and 24 pivot so that they may easily separate from the guide roller assembly 28 allowing both halves of the access door 16 to open. Top guide rollers 32 are positioned in the center of the panels 12 adjacent the access door 16 so that the two halves of the access door pivot open about the hinge members 14. Thus the door opening, which is shown in FIG. 2, extends between the two hinge members 14 on panels 12 adjacent the access door 16. In use, it is found that the panels 12 adjacent the access door 16 tend to commence folding so a wide door opening is attained.

Figure 3:
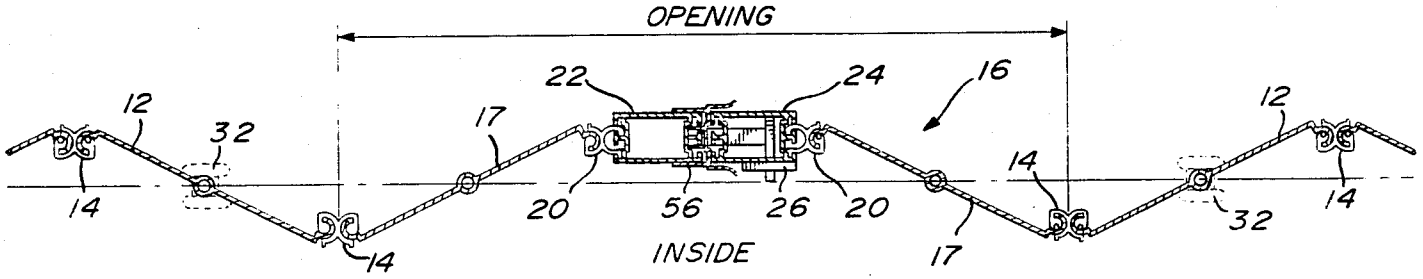
FIG. 3 is a top plan view of another embodiment of a folding access door in a foldable closure assembly.

Another configuration of a folding access door 16 is shown in FIG. 3, wherein the two vertical posts 22 and 24 do not join to a guide roller assembly 28 and, therefore, do not have to remain underneath the top support track. The access door does not have any half panels 18, but has full width panels 17 connected by modified hinge members 20 to the vertical posts 22 and 24. Top support rollers 32 are positioned in the center of the full width panels 12 adjacent the access door 16 so the two halves of the access door pivot about the joining hinge members 14. A rotating latch 26 holds the two vertical posts 22 and 24 locked together, and as there is no guide roller assembly, it is only necessary to push the two vertical posts outwards from the inside, and the access door opens. The rollers 32 on the panels 12 tend to move apart when the posts are unlatched to give a sufficiently wide opening. Handles are not shown in this embodiment, but may be provided if required. In order to comply with certain fire regulations the access door opening should be in the order of 36 inches. The panel width, however, varies and whereas two embodiments of access door 16 are shown, other configurations can be provided using a different number of panels. The number of panels is limited to the strength of the half door to ensure that it can support itself from the adjacent top support rollers 32 without undue sagging.

Figure 4:
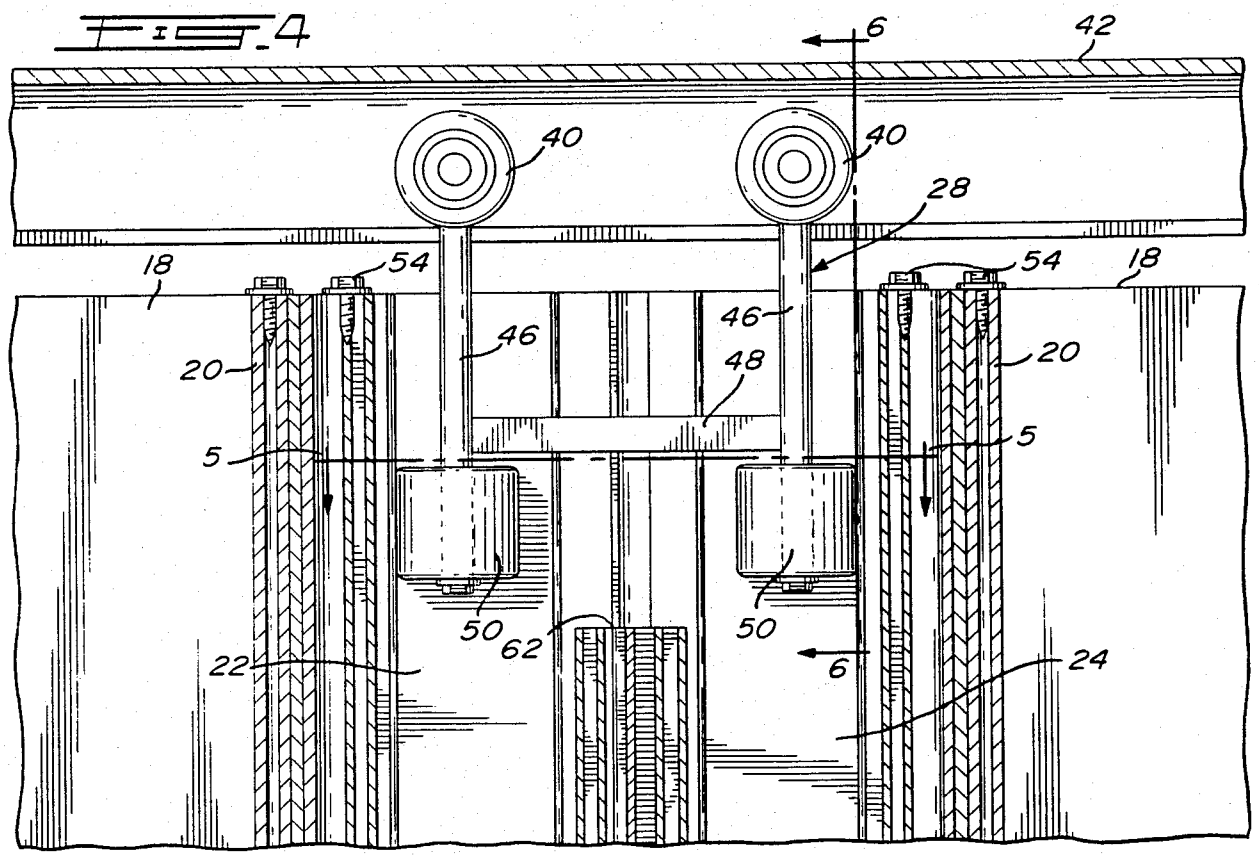
FIG. 4 is a sectional view taken at line 4—4 of FIG. 2 showing details of the guide roller assembly.

Details for the guide roller assembly 28 as shown in FIGS. 1 and 2 are illustrated in FIGS. 4 to 6. The guide roller assembly 28 has top support rollers 40 which are fixed in the top support track 42 and move backwards and forwards. The top support rollers 40 are mounted on each side of a sliding block 44 which has limited vertical movement on a support shaft 46. The two support shafts 46 are connected together by a strut 48, preferably welded in place so that the two support shafts are located a fixed distance apart. Beneath the strut 48 are two rotatable side guide rollers 50 which fit within the two vertical posts 22 and 24 acting as guides for the posts positioning them beneath the support track 42 when the two vertical posts 22 and 24 are latched together.

In the embodiment shown in FIGS. 1 and 3, the vertical posts 22 and 24 are preferably made from an aluminum extrusion, and one side of each post has grooves and slots 52 for joining to a modified hinge member 20 which slides into the grooves and slots and then has screws 54 at top and bottom to prevent the hinge member 20 from separating from the vertical posts 22 and 24. The other side of each post 22 and 24 also has grooves and slots, but these are used for other purposes. The two adjacent sides of the posts join together when the posts are latched together. A guide strip extrusion member 56 is attached to one of the adjacent sides of the vertical post 22 and has two extending guide strip 58 on each side for guiding the second vertical post 24 in between the strips 58 for more easily joining the two vertical posts 22 and 24 together. The guide strip member 56 is shown rigidly attached to the first vertical post 22 by one or more screws 60 fitting through holes drilled in the guide strip member 56 and the vertical post 22. Other types of fastening methods such as spot welding, rivets etc. may be used.

As seen in FIG. 4, the inside top portion of the vertical posts 22 and 24 which are modified for the embodiment shown in FIGS. 1 and 2, have the adjacent sides removed, providing an opening 62 with a U-shaped cross section in the posts 22 and 24 as illustrated in FIG. 5. The guide roller assembly 28 fits within the opening 62 of the two posts when the access door is closed. Thus when the two posts 22 and 24 are separated, they can be pivoted by pushing on the handles 30 and then moved so that the side guide rollers 50 disengage from the U-shaped cross section of the top portions of each post, and remain in the same location. The posts 22 and 24 may be moved and both halves of the access door 16 can be swung open. The side guide rollers 50 are preferably spaced apart as far as possible to fit within the top portion of the posts. This prevents the posts 22 and 24 from pivoting and retains them in line with the top support track 42 when they are latched together. The opening 62 cuts through the adjacent sides of the vertical posts 22 and 24 and also the middle portion of the guide strip member 56. The opening 62 is well below the side guide rollers 50 so it does not interfere with the opening and closing of the door. When the access door is to be closed, then the top portions of the two vertical posts 22 and 24 are pushed over the side guide rollers 50 and then the two vertical posts 22 and 24 are latched together as illustrated in FIG 5. Sufficient clearance is left between the side guide rollers 50 and the insides of the vertical posts 22 and 24 for there to be easy access and egress between the side guide rollers 50 and the U-shaped cross section of the top portion in the vertical posts.

The latch 26 as shown in FIG. 2 is preferably a thumb turn latch located on vertical post 24, and has a lever 64 that rotates on the thumb latch shaft to engage in a slot provided on the adjacent side of the post 22. If required, a key can be provided on the outside of the foldable closure assembly for controlled access to the inside. Furthermore, a panic handle may be placed on the inside of the access door which operates by being pushed. Then by pushing the panic handle, the latch releases, and in the case of the embodiment shown in FIGS. 1 and 2, the two handles 30 are pushed so the vertical posts pivot, and the two halves of the door swing open. In the embodiment shown in FIG. 3, the two halves simply swing open.

In another embodiment the opening 62 in the vertical posts 22 and 24 may include strips positioned on each side above the side guide rollers 50 which engage with the top of the side guide rollers 50 when the door is latched. The strips provide vertical support for the vertical posts 22 and 24 as well as side guiding to ensure the posts 22 and 24 remain in line with the top support track 42.

Whereas the guide strip member 56 is shown as a separate extrusion to the vertical post 24, in another embodiment the unit could be an integral extrusion.

Various changes may be made to the embodiments shown and described herein without departing from the scope of the present invention which is limited only by the following claims.

The embodiments of the invention in which an exclusive property or privilege is claimed are defined as follows.

1. In a foldable closure assembly, including a plurality of panels with adjacent panels vertically hinged together and top support rollers supporting the foldable closure assembly in a top support track; the improvement of a full height folding access door within the foldable closure assembly, the access door having two halves, hinged to adjacent panels, each supported by a support roller in the top support track, comprising two vertical posts, each post vertically hinged to an adjacent access door panel, each post having a top portion with a "U" shaped cross section and an opening on a side facing towards each other;

latching means for joining the two posts together, and guide means comprising two freely rotating cylindrical rollers on two vertical shafts which each fit into the top portions of the two posts, the cylindrical rollers linked together and each supported from a top support roller, the guide means removably fitting in the top portions of the two posts, and supported from the top support track such that when the two posts are latched together, the guide means is retained in the top portions, and when the two posts are unlatched, the posts can pivot and the two halves of the access door wing open leaving the guide means in place.

2. The foldable closure assembly of claim 1 wherein adjacent panels are joined by vertical hinge members, and the vertical posts are each rigidly connected to a vertical hinge member which is hingedly joined to a half panel.

3. The foldable closure assembly of claim 2 wherein each half of the access door extends for one panel and one half panel from each vertical post, and swings open at a vertical hinge member.

4. The foldable closure assembly of claim 1 including side handles eccentrically located on each post such that pushing on the handles pivots the posts permitting the guide means to separate from the top portion of the post.

5. The foldable closure assembly of claim 1 wherein the latching means comprises a rotatable latch with a hook to connect the two posts together and a latch handle accessible from inside the foldable closure assembly.

6. The foldable closure assembly of claim 1 wherein one of the two vertical posts has vertical guide strips at one side to act as door closing guides for the other vertical post, and holds the two posts firmly together when the two posts are latched.

* * * * *